US006615872B2

(12) United States Patent
Goebel et al.

(10) Patent No.: US 6,615,872 B2
(45) Date of Patent: Sep. 9, 2003

(54) FLOW TRANSLOCATOR

(75) Inventors: Steven G. Goebel, Victor, NY (US); Steven D. Burch, Honeoye Falls, NY (US); Thomas P. Migliore, Rochester, NY (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/897,335

(22) Filed: Jul. 3, 2001

(65) Prior Publication Data

US 2003/0007419 A1 Jan. 9, 2003

(51) Int. Cl.[7] ..... B01F 5/06; F28F 13/12

(52) U.S. Cl. ..... 138/38; 138/37; 165/109.1; 366/340

(58) Field of Search ..... 366/336, 337, 366/340; 165/109.1; 138/37, 38, 40, 42, 39; 48/189.4; 55/441, 445, 446; 261/109, 113; 181/264, 265, 270, 281; 454/310

(56) References Cited

U.S. PATENT DOCUMENTS

| | | | | |
|---|---|---|---|---|
| 1,113,041 | A | * | 10/1914 | Murphy |
| 2,598,763 | A | * | 6/1952 | De Roo |
| 3,128,794 | A | | 4/1964 | Boucher et al. ..... 138/37 |
| 3,470,912 | A | | 10/1969 | Bydal ..... 138/37 |
| 3,470,913 | A | * | 10/1969 | Body |
| 3,470,914 | A | * | 10/1969 | Smith |
| 3,582,045 | A | | 6/1971 | Leybourne |
| 3,779,282 | A | * | 12/1973 | Klees |
| 3,791,414 | A | | 2/1974 | Anand et al. ..... 138/37 |
| 3,792,584 | A | * | 2/1974 | Klees |
| 3,802,668 | A | | 4/1974 | Charles-Messance |
| 4,050,676 | A | | 9/1977 | Morishima et al. ..... 366/339 |
| 4,085,583 | A | * | 4/1978 | Klees |
| 4,165,609 | A | * | 8/1979 | Rudolph |
| 4,363,552 | A | * | 12/1982 | Considine |
| 4,823,865 | A | | 4/1989 | Hughes ..... 165/109.1 |
| 4,881,596 | A | | 11/1989 | Bergmann et al. ..... 165/174 |
| 4,899,812 | A | | 2/1990 | Altoz ..... 165/109.1 |
| 4,981,368 | A | | 1/1991 | Smith ..... 366/337 |
| 5,029,636 | A | | 7/1991 | Kadle ..... 165/109.1 |
| 5,167,275 | A | | 12/1992 | Stokes et al. ..... 165/109.1 |
| 5,291,943 | A | | 3/1994 | Dhir ..... 165/109.1 |
| 5,307,867 | A | | 5/1994 | Yasuda et al. ..... 165/109.1 |
| 5,312,185 | A | | 5/1994 | Kojima et al. ..... 366/339 |
| 5,492,409 | A | | 2/1996 | Karlsson et al. ..... 366/338 |
| 5,659,158 | A | * | 8/1997 | Browning et al. |
| 5,758,967 | A | | 6/1998 | King ..... 366/337 |
| 5,800,059 | A | | 9/1998 | Cooke et al. ..... 366/337 |
| 5,811,048 | A | * | 9/1998 | Dunn et al. |
| 6,000,841 | A | | 12/1999 | Cooke et al. ..... 366/337 |
| 2002/0110047 | A1 | * | 8/2002 | Bruck et al. |

FOREIGN PATENT DOCUMENTS

| | | | |
|---|---|---|---|
| DE | 808 766 | * | 7/1951 |
| DE | 100 27 653 | * | 12/2001 |
| EP | 0 063 729 A2 | * | 4/1981 |
| GB | 891212 | * | 3/1962 |
| WO | WO 01/12960 A1 | * | 2/2001 |

* cited by examiner

*Primary Examiner*—Charles E. Cooley
*Assistant Examiner*—David Sorkin
(74) *Attorney, Agent, or Firm*—Cary W. Brooks

(57) ABSTRACT

A flow translocator disposed within a conduit for transferring and separating laminar fluid flow during translocation of the fluid core to the outer perimeter of the conduit and the outer perimeter flow to the center of the conduit. The flow translocator includes a disk disposed transverse the length of a conduit and having an outer profile conforming to the inner profile of a conduit to form a sealed fit. Arrays of slots extend about the disk for simultaneously directing the fluid core to the inner profile of a conduit and the outer perimeter flow toward the fluid core. The slots are staggered to maintain separation of the fluid core and the outer perimeter fluid during translocation.

5 Claims, 5 Drawing Sheets

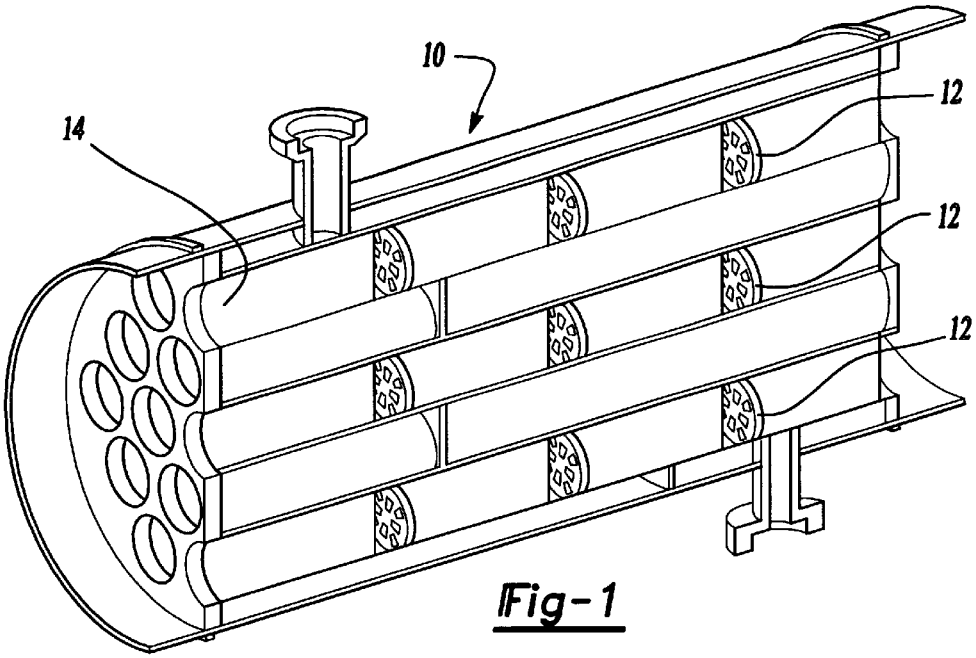
Fig-1
Fig-2 PRIOR ART
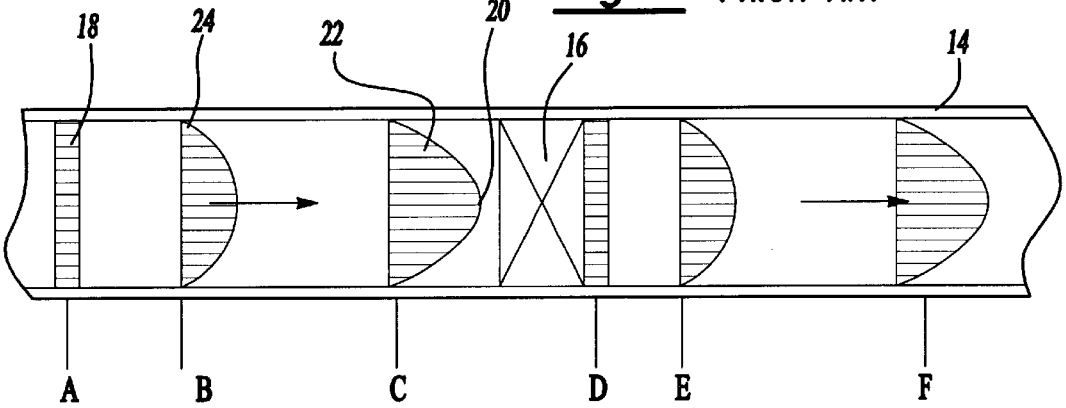
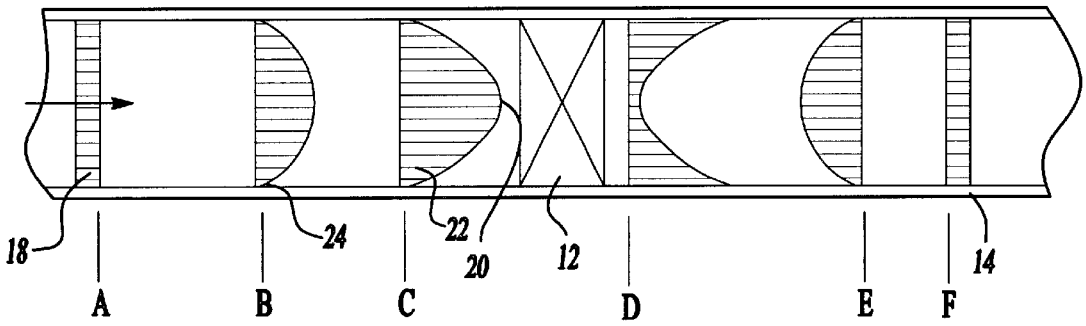
Fig-3

FLOW TRANSLOCATOR

TECHNICAL FIELD

The present invention relates generally to a fluid flow translocator device for improving the method of dispersing temperature gradients found in laminar flow through heat exchangers and reactors.

BACKGROUND OF THE INVENTION

It is known that heat exchangers and reactors develop temperature gradients that tend to be influenced by the direction of thermal radiation. Such gradient typically approaches a parabolic distribution of heat across the cross section of a conduit. The center or core of the laminar flow is the hottest and the last to cool. This results from isolation of the core of the laminar flow as the cooler, outer perimeter fluid confines the core. While the cooling rates of heat exchangers can often be adequate for operation, such rates do not always optimize the time required to cool the fluid. This results in oversized heat exchangers and associated increases in costs. Similarly, reactors require a specific stabilized temperature to enable proper chemical reactions. The temperature gradient and heat distribution becomes much more important in this scenario.

It is known to integrate a plurality of static mixing inserts into heat exchangers and reactors. Static mixing inserts have been employed to convert the heated core of the laminar flow to a turbulent flow with a median temperature. The result is an increase in temperature of the outer perimeter fluid juxtaposed to the conduit walls and an overall increase in heat emission. While these static fluid mixing inserts somewhat reduce the core temperature of the flow, potential heat dissipation often is not maximized, thus potentially allowing the temperature gradient to be quickly reestablished and creating a need for additional mixing inserts. The fluid experiences a pressure drop across each mixing insert. Therefore, the addition of each mixing insert generally requires additional energy necessary to achieve the desired mixing while moving the fluid through the conduit.

Accordingly, there is a need for a simple, low cost device what can dissipate heat more efficiently thereby minimizing heat gradients and creating a more stable environment for chemical reactions where required.

SUMMARY OF THE INVENTION

The present invention meets the above needs by providing an improved apparatus for translocating higher temperature fluid as between an inner core of a fluid to a cooler conduit wall in the absence of mixing of laminar fluid.

The apparatus includes a flow translocator disposed within a conduit for transferring and separating laminar fluid flow during translocation of the fluid core to the outer perimeter of the conduit and the outer perimeter flow to the center of the conduit. The flow translocator includes a disk disposed transverse the length of a conduit and having an outer profile conforming to the inner profile of a conduit to form a sealed fit. Arrays of slots extend about the disk for simultaneously directing the fluid core to the inner profile of a conduit and the outer perimeter flow toward the fluid core. The slots are staggered to maintain separation of the fluid core and the outer perimeter fluid during translocation.

These and other objects, aspects, and advantages of the present invention will become apparent upon reading the following detailed description in combination with the accompanying drawings, which depict systems and components that can be used alone or in combination with each other in accordance with the present invention.

BRIEF DESCRIPTION OF THE DRAWINGS

FIG. 1 is a cut-away perspective view of a tube-in-shell type catalytic reacting heat exchanger showing a series of flow translocators of the present invention;

FIG. 2 is a schematic view of the temperature profile through a conduit using a typical flow static mixer of the prior art;

FIG. 3 is a schematic view of the temperature profile through a conduit using a preferred embodiment of the present invention;

DESCRIPTION OF THE PREFERRED EMBODIMENT

Figure 4:
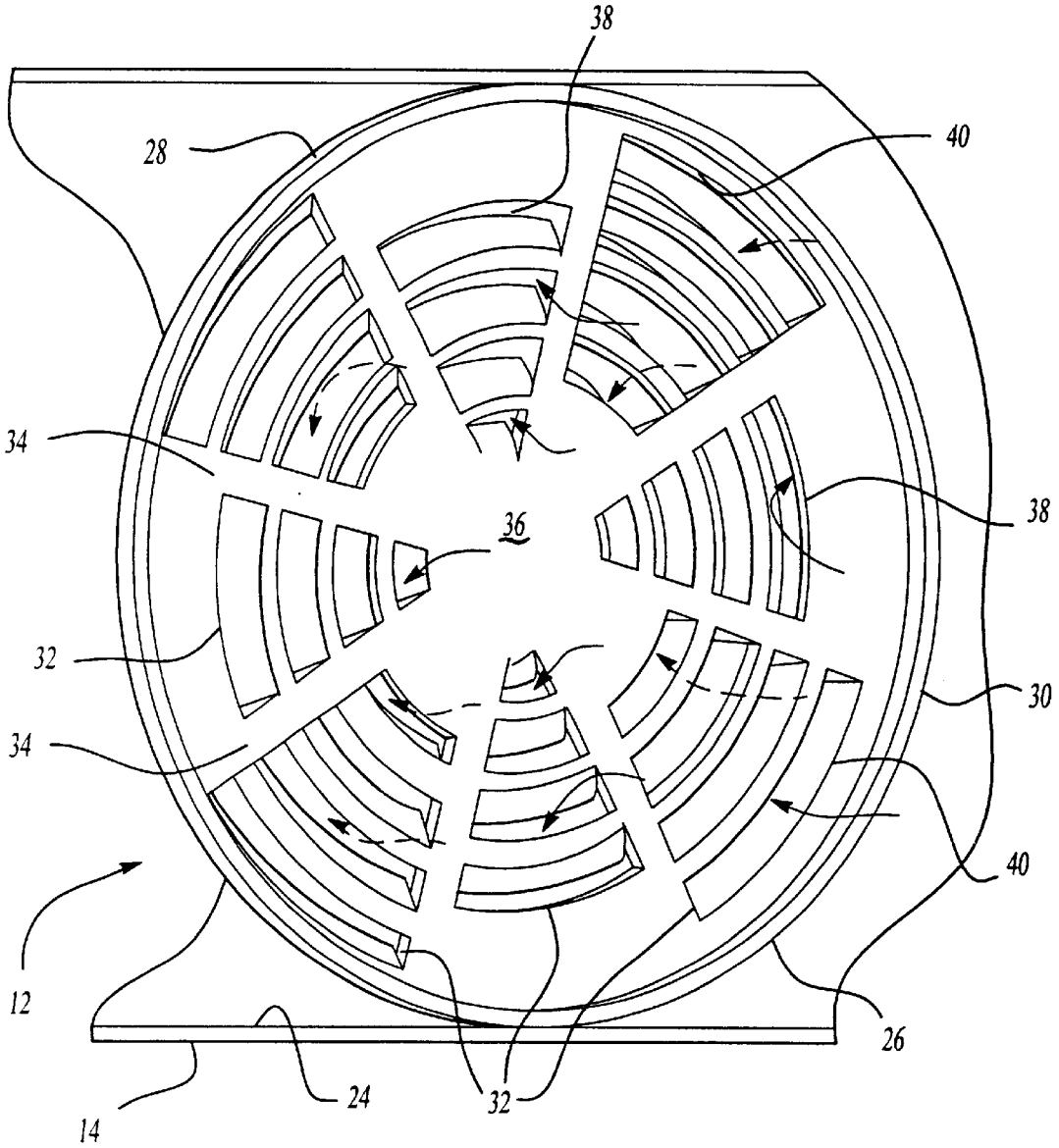
FIG. 4 is a perspective view of the first preferred embodiment of the present invention.

With reference first to FIG. 1, a tube-in-shell type catalytic reacting heat exchanger 10 is there shown in a cutaway view having a series of flow translocators 12 of the present invention disposed at intervals within a conduit 14.

FIGS. 2 and 3 illustrate the difference in the temperature profile of the laminar flow fluid (points A–F) using a static mixer 16 of the prior art (FIG. 2) versus a flow translocator 12 of the present invention (FIG. 3) for dispersing the temperature gradient within a conduit 14. In this example, the laminar fluid 18 is flowing from right to left and has a fluid core 20 temperature warmer than the outer perimeter flow 22. Points A–C illustrate laminar flow 18 within a conduit 14 forming a typical parabolic temperature gradient from the interior wall 24 of the conduit 14 extending radially outward toward the center of the conduit 14. After passing through the static mixer 16, the fluid core 20 and outer perimeter flow 22 are successfully mixed to create an equal temperature within the fluid as illustrated by point D of FIG. 2. Immediately after mixing the two fluid flows, however, the fluid begins to re-form a parabolic temperature gradient (points E and F) and requires a second static mixer at point D to remix and recreate an equal temperature flow within the conduit 14.

FIG. 3 illustrates the temperature gradient of the laminar fluid flow 18 after passing through a flow translocator 12. Unlike the prior art static mixer 16, the temperature of the fluid core 20 is cooler than the outer perimeter flow 22, forming an inverted parabolic temperature gradient at point D. Once the fluids 20,22 begin to mix, the temperature begins to equalize at point F. Thus, when a static mixer 16 of the prior art in FIG. 2 is replaced with a fluid translocator 12 of the present invention, a parabolic temperature gradient does not begin to redevelopment until after point F within the conduit 14, diminishing the amount of inserts needed to maintain a uniform temperature.

FIG. 4 illustrates a first preferred embodiment of the flow translocator 12 of the present invention disposed within a conduit 14. A disk 26 lies transverse in the conduit 14 and has an outer profile 28 substantially conforming to (e.g. equal to) the inner profile of the conduit 14 to form a sealed fit along the interior wall 24. A suitable structure such as a lip 30 may be provided to help ensure a tight seal. Arrays of slots 32 are arranged about the disk 26. The arrays 32 are louvered to direct the fluid core 20 toward the outer perimeter flow 22 and vice-versa. The arrays 32 are staggered or alternated and have a partition 34 between each array 32 to prevent mixing of the flows 20,22 while the fluid passes through the flow translocator 12. The arrays 32 converge toward a transversely extending central disk 36. The central disk 36 is a solid wall that directs the core fluid 20 outwardly to be directed by the louvered arrays 32 toward the interior wall 24 of the conduit 12.

In FIG. 4, the laminar fluid flow 18 is illustrated as travelling horizontally from right to left. The core fluid 20 strikes the central disc 36 and is directed to the alternating arrays 32 of outwardly angled louvered slots 38. The outer perimeter flow 22 is directed to the alternating arrays 32 of inwardly angled louvered slots 40. Partitions 34 maintain separation of the fluid flows 20,22 during the translocation process to ensure the desired temperature gradient shown in FIG. 3. Additionally, the multiple louvered slots 38,40 allow for a minimal pressure loss and subsequent decrease in fluid velocity during translocation. The fluid translocator 12 may be formed by a stamping process and is preferably symmetrical along its vertical axis to allow for independence of installation orientation.

Figure 5:
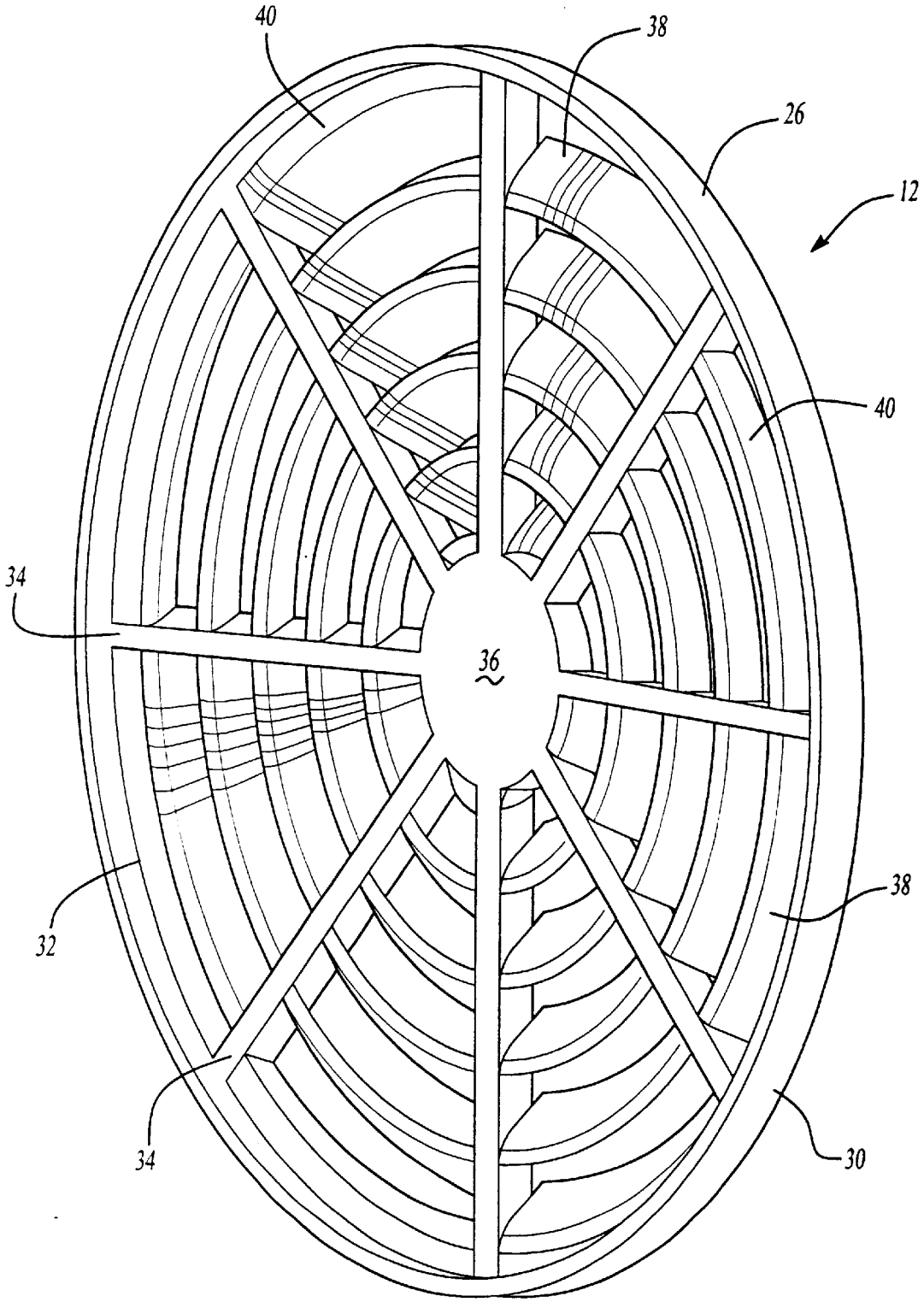
FIG. 5 is a perspective view of a second alternative embodiment of the present invention.

FIG. 5 illustrates a flow translocator 12 similar to that shown in FIG. 4 but having more louvered slots 38, 40 to aid in decreasing pressure loss and fluid velocity as the fluid 20,22 travels through the disk 26.

Figure 6:
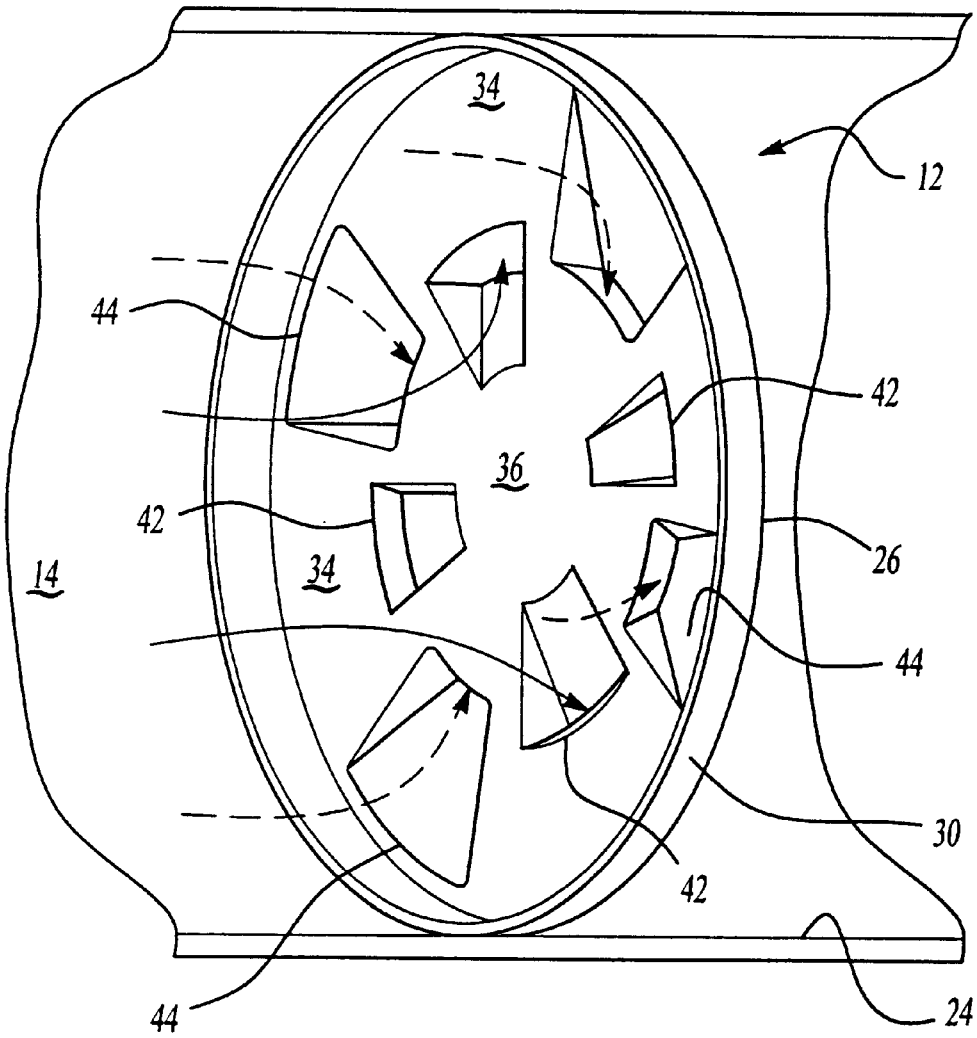
FIG. 6 is a perspective view of a third alternative embodiment of the present invention.

FIG. 6 illustrates another preferred embodiment of the flow translocator 12 of the present invention. A disk 26 extends transverse in the conduit 14 and has an outer profile 28 equal to the inner profile of the conduit 14 to form a sealed fit along the interior wall 24. A lip 30 may be provided to ensure a tight seal. A vertically transversely central disk 36 is located within disk 26 and forms a solid wall. A first slot 42 extends at an angle between the central disk 36 and the lip 30 of disk 26. The central disk 36 directs the core fluid 20 outwardly to be directed by the first slot 42 toward the interior wall 24 of the conduit 14.

A second slot 44 extends at an angle between the disk 26 and central disk 36 for directing the outer perimeter flow 22 toward the center of the conduit 14 to displace the core fluid 20. Partitions 34 maintain separation of the fluid flows 20,22 during the translocation process to ensure the desired temperature gradient shown in FIG. 3. The fluid translocator 12 may be formed by a stamping process and is preferably symmetrical along its vertical axis to allow for independence of installation orientation.

Figure 7:
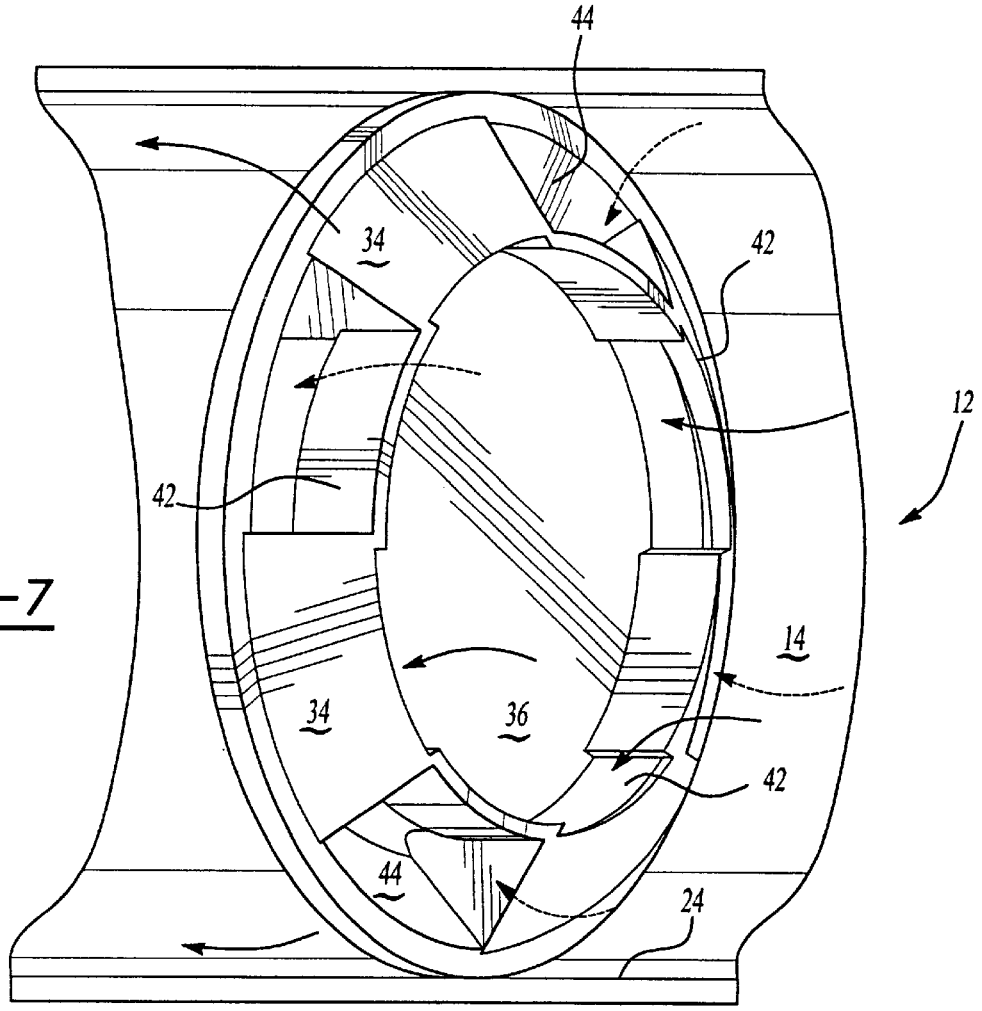
FIG. 7 is a perspective view of a fourth alternative embodiment of the present invention.

FIG. 7 illustrates a flow translocator 12 similar to that shown in FIG. 6 but having less alternating first and second slots 42,44 and a greater partition area 34. This configuration provides the cleanest fluid inversion during the translocation process.

Figure 8:
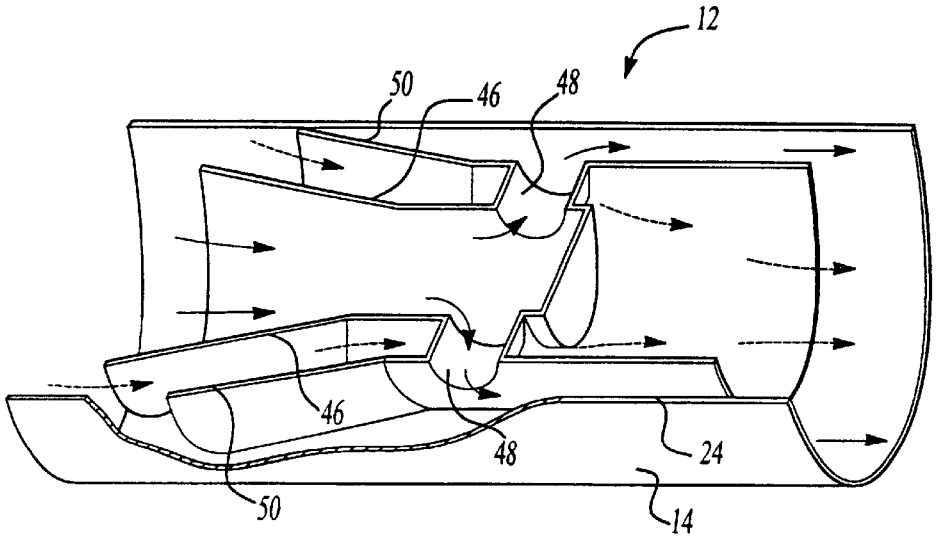
FIG. 8 is a perspective view of a fifth alternative embodiment of the present invention.

FIG. 8 illustrates a flow translocator 12 having a cone-shaped insert 46 that confines the fluid core 20 (see FIG. 3) of a laminar fluid flow 18 and transports it to the interior wall 24 of the conduit 12 through an array of tubes 48. The outer perimeter flow 22 is also confined through an outer cone 50 and is directed toward the fluid core 20 of the laminar fluid flow 18. While the translocation is taking place, generally none of the fluids 20,22 will come in contact, thus transmitting the higher temperature fluid to the outer perimeter flow 22 along the interior wall 24 of the conduit 14. With a plurality of these translocators located throughout the heat exchanger 10 (FIG. 1,) it is possible to reduce the temperature of the fluid flow in a shorter period of time while reducing the number of such inserts required.

It should be understood that the invention is not limited to the exact embodiment or construction which has been illustrated and described but that various changes may be made without departing from the spirit and the scope of the invention.

What is claimed is:

1. A flow translocator disposed within a conduit within a heat exchanger or reactor for transferring and separating laminar fluid flow during translocation of the fluid core to the outer perimeter of the conduit and the outer perimeter flow to the center of the conduit, the flow translocator comprising:

an outer disk disposed transverse to the length of said conduit and having an outer profile conforming to the inner profile of said conduit to form a sealed fit;

a central disk disposed within said outer disk transverse to the length of said conduit and having a solid face for redirecting said core fluid from said center of said conduit toward said outer perimeter of said conduit;

a first louvered slot extending at an angle between said central disk and said outer disk for directing said core flow to said outer perimeter of said conduit to form said outer perimeter flow;

a second louvered slot extending at an angle between said outer disk and said central disk for directing said outer perimeter flow toward said central disk to form said core fluid; and a solid partition extending between said first and second louvered slots for maintaining separation between said core fluid and said outer perimeter flow during said translocation of said fluids.

2. The flow translocator of claim 1, further comprising an array of said first and second louvered slots about said central disk.

3. The flow translocator of claim 2, wherein said louvered slots are staggered between said first louvered slot array and said second louvered slot array about said central disk.

4. The flow translocator of claim 1, said outer disk further comprising a lip extending about said outer profile for securing said sealed fit between said translocator and said conduit.

5. The flow translocator of claim 1, wherein said translocator is symmetrical along a vertical axis.

* * * * *